United States Patent [19]

Taylor et al.

[11] Patent Number: 4,894,039

[45] Date of Patent: Jan. 16, 1990

[54] LEVITATING TOY FLYING SAUCER PACKAGING AND STORAGE

[76] Inventors: Zenn R. Taylor, 4333 Harbor House Dr., Tampa, Fla. 33615; Lester D. Barton, 12833 N. 17th Ave., Phoenix, Ariz. 85029

[21] Appl. No.: 239,308

[22] Filed: Sep. 1, 1988

[51] Int. Cl.[4] ..... A63H 27/10

[52] U.S. Cl. ..... 446/75; 446/76; 446/220; 229/110

[58] Field of Search ..... 446/220, 225, 221, 75, 446/76, 80, 93, 231, 488, 88, 77, 79; 229/110

[56] References Cited

U.S. PATENT DOCUMENTS

| | | | |
|---|---|---|---|
| 1,755,161 | 4/1930 | Weimer | 446/225 X |
| 1,924,236 | 8/1933 | Friedberg . | |
| 2,036,662 | 4/1936 | Weeks . | |
| 2,984,401 | 5/1961 | Herkender | 229/110 X |
| 3,515,332 | 6/1970 | Smith | 229/110 X |
| 3,591,975 | 7/1971 | Terc . | |
| 3,703,256 | 11/1972 | Ross | 229/110 X |
| 3,968,898 | 7/1976 | Beer | 446/231 X |
| 4,038,777 | 8/1977 | Schwartz . | |
| 4,077,588 | 3/1978 | Hurst . | |
| 4,131,227 | 12/1978 | Patton et al. . | |
| 4,169,593 | 10/1979 | Wood | 446/220 X |
| 4,307,537 | 12/1981 | Bergmann . | |
| 4,433,504 | 2/1984 | Terui . | |
| 4,547,167 | 10/1985 | Bergmann . | |

*Primary Examiner*—Mickey Yu

*Attorney, Agent, or Firm*—Nixon & Vanderhye

[57] ABSTRACT

A lighter-than-air toy balloon storage container is provided which is shaped to resemble a toy space station, aircraft hanger, or the like in order to integrate the storage container into the overall toy construction. The container may be formed in the shape of an octahedron from a one-piece cardboard or paperboard blank with top, bottom, side and end walls. One or both of the end walls may be hinged to permit insertion or withdrawal of the associated balloon toy, the latter shaped to resemble a toy flying saucer or the like. One or more of the container walls may also be provided with transparent inserts, as well as indicia enhancing the unique appearance of the container.

9 Claims, 3 Drawing Sheets

LEVITATING TOY FLYING SAUCER PACKAGING AND STORAGE

BACKGROUND AND SUMMARY OF THE INVENTION

This invention relates to toys and storage devices therefore and, specifically, to a unique container for storing a balloon toy filled with a lighter than air gas such as helium.

Balloons of the above described type are known wherein a fixed volume of lighter than air gas is confined within a closed envelope, and ballast means are provided in the form of removable weights which enable the balloon to be brought into balance at a desired height above the ground. Exemplary balloon constructions of this type are described in U.S. Pat. Nos. 4,547,167; 4,307,537; 4,038,777; 3,591,975 and 1,924,236.

It is often the case, however, that during non play time, for example, at night, a lift-balanced balloon of this type will drift away from its originally intended "resting place" simply as a result of circulating air currents within a room. There is therefore a need for some means by which a balloon of this type can be constrained, if desired, for periods of time as desired. The use of strings, typically used to tie down helium filled balloons, is not an attractive solution here where the balloon is designed to resemble a "flying saucer" type vehicle, and the use of a string would detract from the realism of the toy.

The present invention offers an alternative solution to this problem in a unique way which employs a packaging container which is designed for integrated use with the balloon as part of the overall toy construction, e.g., where the balloon toy is designed to resemble a flying saucer or other flying vehicle, the container or package is correspondingly designed to simulate a space station, aircraft hanger or the like so that a child does not view the container merely as a storage box, but rather as an extension of the balloon toy itself, as described in more detail below.

In a preferred embodiment of the invention, the balloon carries indicia and/or other decoration, and, as already noted, is shaped to cause the balloon to take on the appearance of a space ship (e.g., flying saucer). At the same time, the container in which the balloon may be packaged and sold is shaped to take on the appearance of a space station, hanger, or mother ship for receiving the flying saucer-like balloon through a hinged opening or "port". In this manner, the child understands the container or package to be an integral part of the overall toy structure or design (i.e., a toy itself), to be used at will during playtime, but also providing a convenient storage mechanism when the child decides to move on to another toy, or when it is time to put the toy aside. Of course, the child's creative imagination is free to continue the activity by, for example, imagining the flying saucer has been recalled to the space ship for refueling, repairs or the like. In addition, the unique container construction of this invention prevents the balloon from wandering due to air currents, or other forces.

In one exemplary embodiment of the invention, the storage container is constructed from a single blank of cardboard, paperboard, plastic or other suitable sheet material, folded to form a hollow housing which, in cross-section, may be of hexagonal shape, i.e., with six sides. At the same time, end walls are provided so that the overall three dimensional configuration is that of an octahedron. At least one of the side walls is capable of hinged movement between open and closed positions, and one or both of the end walls may also include a transparent insert of cellophane or the like.

It will be understood that the overall size of the container is determined by the size of the balloon toy, so that the latter may be slidably received within the former through the openable end wall.

Suitable indicia and/or other decorations may be applied to the container to enhance the space station, hanger of the like design.

Other objects and advantages of the subject invention will become apparent from the detailed description which follows.

DETAILED DESCRIPTION OF THE DRAWINGS

Figure 1:
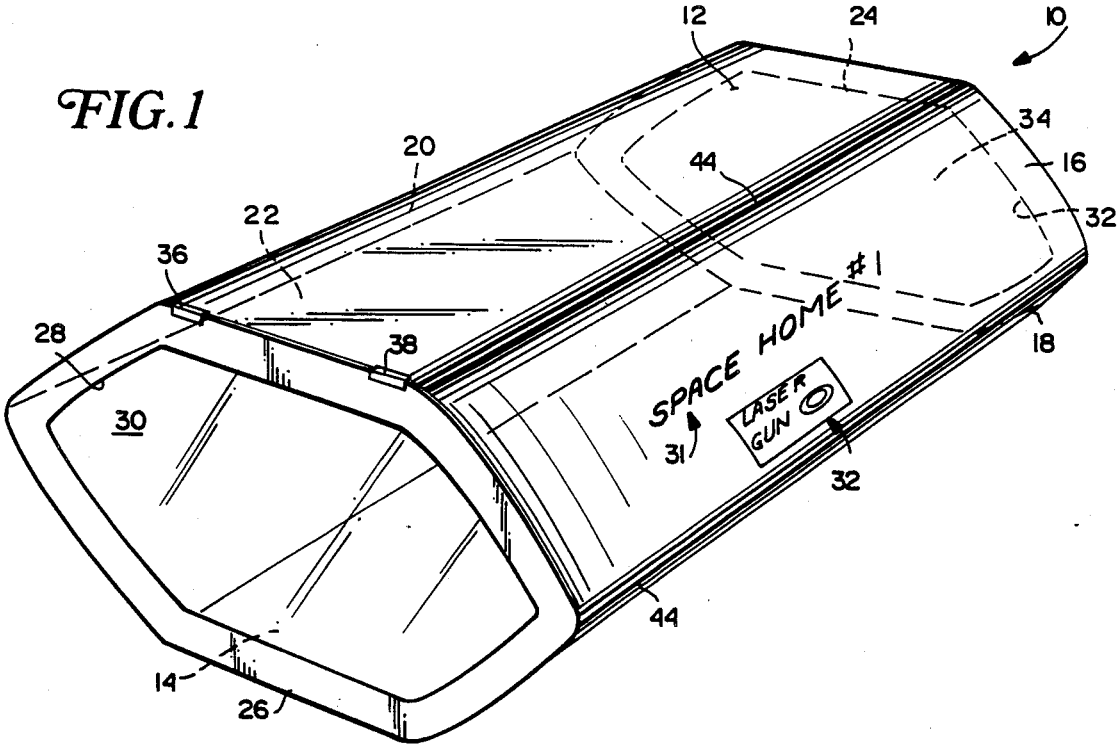
FIG. 1 is a perspective view of a container for housing a balloon toy in accordance with the invention.
Figure 2:
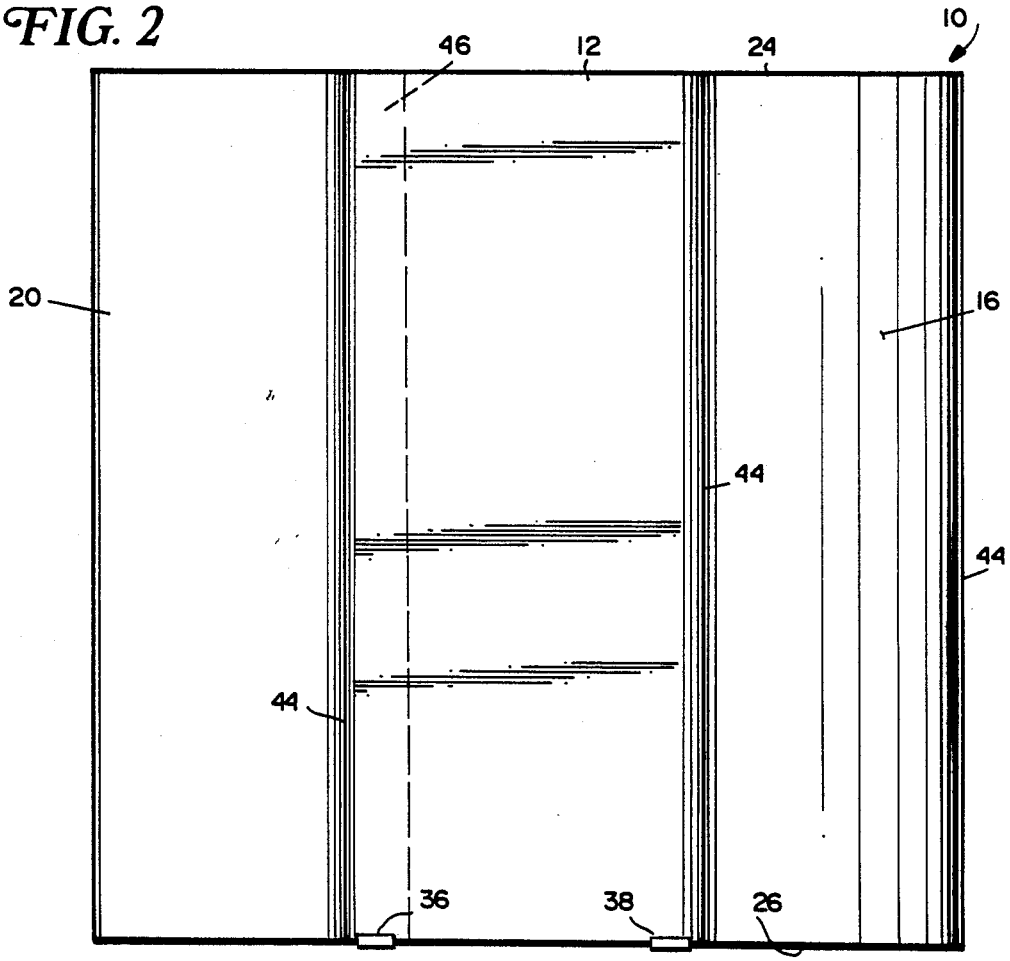
FIG. 2 is a plan view of the container illustrated in FIG. 1.
Figure 3:
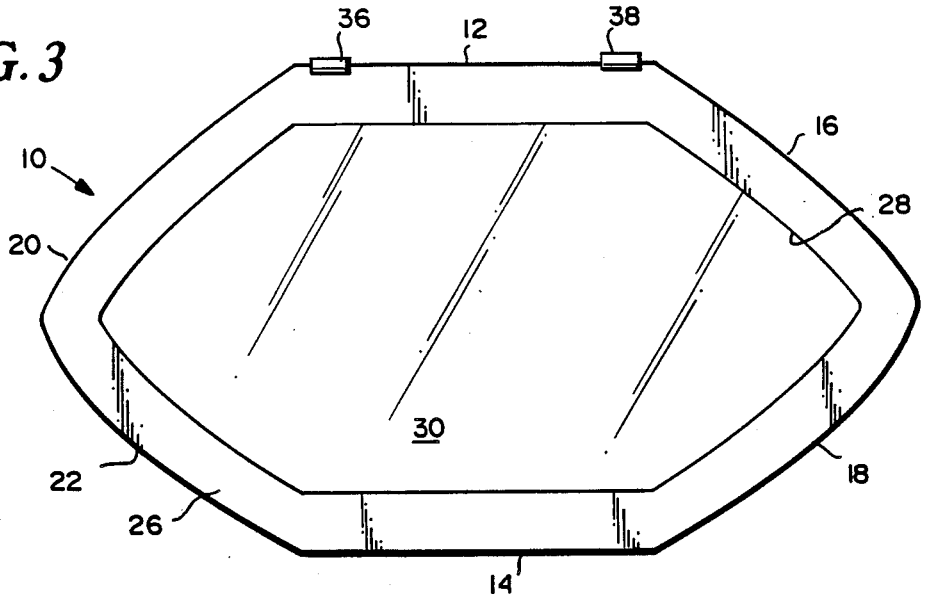
FIG. 3 is a front view of the container illustrated in FIG. 1.

With reference now to FIGS. 1–3, a container 10 is illustrated which is shaped to simulate the appearance of a space station, aircraft hanger, or the like toy for use with an associated balloon toy shaped to resemble a flying saucer or other shape vehicle. The container 10 is formd with a top wall 12, a bottom wall 14, a first pair of angled side walls 16, 18 which connect the top and bottom walls on one side of the container, and a second pair of angled side walls 20 and 22 which interconnect the top and bottom walls on the other side of the container. The container also ncludes a pair of end walls 24 and 26.

One or both of the end walls 24, 26 may be cut out to form a window-like aperture 28 which may be covered by a transparent plastic material 30. The transparent material may be any suitable plastic film type composition such as cellophane or the like, preferably adhered to the end wall 26 by a conventional adhesive or other suitable means. A similar arrangement may be provided on the opposite end wall 24 where a cut out portion defining a window 32 may be covered by a similar transparent material 34. Similar inserts may be provided on one or more of the top, bottom and side walls as well. On the other hand, it will be understood by those of ordinary skill in the art that, in an alternative construction, either or both of end walls 24, 26 may be of solid panel construction without apertures or the window-like appearance illustrated in FIG. 1.

Preferably one or all of the walls 12, 20, 22, 16, 18, etc. have indicia 31 thereon which helps the container simulate a space station (e.g., representations of pipes, hatches, etc., lettering like "Zero Gravity Hatch" or "U.S. Space Station #1", etc.). The indicia may be applied directly to the walls (31) on labels (e.g., 32), or on a paper covering.

At least one of the end walls 24, 26 is provided with releasable fastening means 36, 38 which may be of any conventional construction, but preferably hook and loop fastener means known as Velcro ®, with one element (e.g., hooks) on the end wall 26, and the other (e.g., loops or pile) on the top wall 12. Other suitable latching mechanisms, including flaps insertable within corresponding apertures or slits, repositionable adhesive strips, or the like, may also be used.

The openable end wall, e.g., end wall 26, is preferably formed as an extension of the blank which forms the remaining walls of the container as will be described in greater detail below, and which folds about a fold line 40 interconnecting the bottom wall 14 to the end wall 26. It will be appreciated that the arrangement may be reversed, such that the openable end wall hinges about a fold line which interconnects the end wall with the top wall 12, while the fastening means are located adjacent the bottom wall 14. It will be appreciated that the opposite end wall, i.e., end wall 24, may be constructed similarly, or in a permanently closed position.

Figure 4:
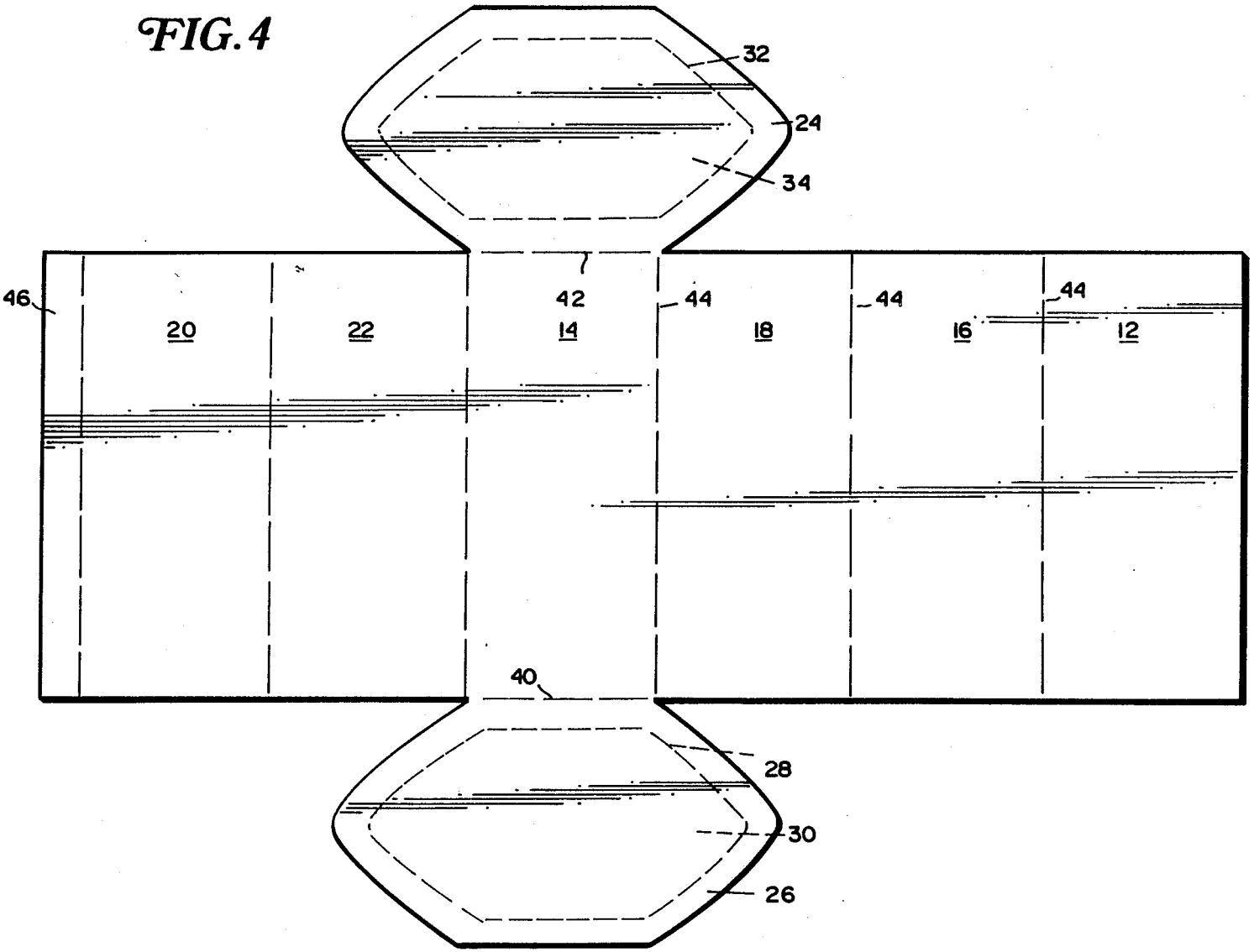
FIG. 4 is a plan view of a single blank construction which may be used to form the container illustrated in FIG. 1.

With reference now to FIG. 4, a blank construction is shown by which the container illustrated in FIG. 1 may be formed by a single piece of paperboard, fiberboard, cardboard, plastic or other suitably flexible, lightweight sheet material. As shown in FIG. 4, the container walls 12, 14, 16, 18, 20, and 22 are defined by a series of transversely extending fold lines 44. At the same time, the end walls 24, 26 comprise lateral extensions of the blank which are foldable about lines 40, 42, respectively extending substantially perpendicularly relative to fold lines 44. An additional panel 46 is provided at one (or the other) end of the blank to provide an overlap facilitating the formation of the container as described below. It will be appreciated from FIGS. 4 and 2 that after the container is formed by folding about fold lines 44 to the shape illustrated in FIGS. 1 to 3, the additional panel 46 engages the upper panel 12 in overlapping relationship. This overlap panel may be provided with adhesive, tape, or any other suitable mechanical means (e.g., staples) for fastening the two ends of the blank together to thereby secure the blank in its desired shape, with the further assistance of end walls 24, 26.

The three dimensional overall configuration of the container is preferably generally that of an octahedron, i.e. an eight-sided figure. In this regard, the fold lines and panels are designed to conform to the outline of end walls 24, 26 which have a substantially hexagonal shape. It will be appreciated that in the event only one of the end walls, for example, end wall 26, is openable with respect to the container, the second end wall 24 will be adhesively secured to the edges of the main blank portion to provide further reinforcement and shape retention for the container. However, it is within the scope of the invention to have both end walls 24, 26 openable in order to permit access to the container from either end.

Figure 6:
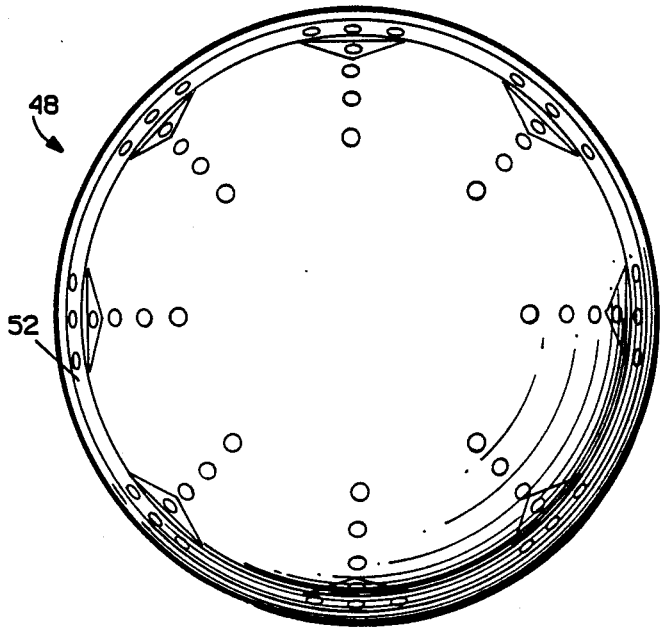
FIGS. 5 and 6 illustrate front and plan views, respectively, of a balloon toy for use in combination with the container illustrated in FIG. 1.
Figure 5:
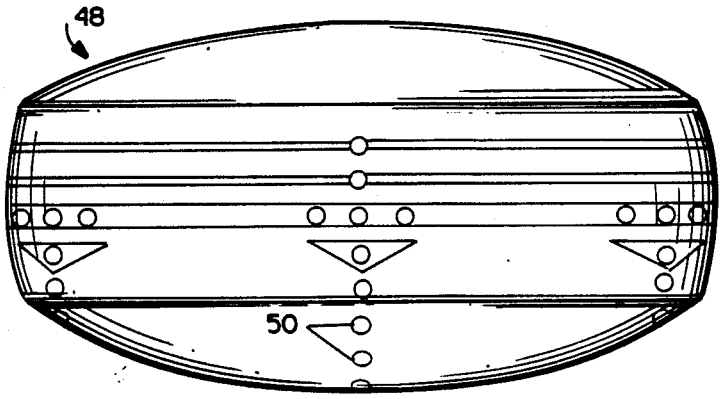

With reference to FIGS. 5 and 6, there is shown a balloon toy construction which comprises a substantially circular body 48 provided with a plurality of small, removable weights 50, which may be no more than adhesively secured paper or paperboard (e.g., labels) weights which permit the balloon to be lift-balanced to allow it to hover at a predetermined height above the ground. The balloon toy, which is shaped and decorated to take on the appearance of a space ship, preferably a flying saucer, has a substantially round peripheral surface 52. Of course, other balloon toy shapes and constructions may be used in combination with the container or package disclosed herein.

It will be appreciated that the container 10 and the balloon 58 are sized to permit the balloon toy in a fully or partially inflated state, to be inserted and withdrawn from the container 10 through one or more openable doors or ports defined by end walls 24, 26.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combination balloon toy and storage container comprising:

(a) an inflatable balloon toy shaped to resemble a toy flying saucer-type vehicle;

(b) a container for storing said balloon toy in at least a partially inflated state, said container shaped and provided with indicia to simulate the appearance of a toy space station, said container including at least one openable wall for permitting said balloon toy to be inserted and withdrawn from said container.

2. The combination defined in claim 1 wherein said balloon has a substantially circular peripheral surface when viewed in plan, and said container has a substantially square peripheral surface when viewed in plan.

3. The combination of claim 1 wherein said container is shaped to have the form substantially of an octahedron.

4. The combination of claim 3 wherein said container as viewed in the direction of one of said end walls, has a substantially hexagonal cross-sectional shape.

5. The combination of claim 1 wherein the container comprises a single blank cut and folded to form top, bottom, side and end walls, said openable wall being one of said end walls.

6. The combination of claim 5 wherein at least one of said end walls includes a transparent insert.

7. The combination of claim 5 wherein at least one of said top, bottom, side and end walls is provided with a transparent insert.

8. The combination of claim 5 wherein one of said top and bottom walls includes overlapping portions and means for securing said portions together.

9. The combination of claim 5 wherein at least one said end wall is openable about a fold line and further wherein means are provided for releasably securing said openable end wall to one of said top and bottom wall.

* * * * *